US010106306B2

(12) United States Patent
Dunn

(10) Patent No.: US 10,106,306 B2
(45) Date of Patent: Oct. 23, 2018

(54) CAN END FOR PRESSURIZED METAL FOOD CAN WITH SHIELDED VENT SCORE

(71) Applicant: Silgan Containers LLC, Woodland Hills, CA (US)

(72) Inventor: David Dunn, Oconomowoc, WI (US)

(73) Assignee: Silgan Containers LLC, Woodland Hills, CA (US)

( * ) Notice: Subject to any disclaimer, the term of this patent is extended or adjusted under 35 U.S.C. 154(b) by 121 days.

(21) Appl. No.: 15/289,421

(22) Filed: Oct. 10, 2016

(65) Prior Publication Data

US 2017/0029194 A1 Feb. 2, 2017

Related U.S. Application Data

(63) Continuation of application No. PCT/US2015/032433, filed on May 26, 2015.

(60) Provisional application No. 62/005,663, filed on May 30, 2014.

(51) Int. Cl.

| | |
|---|---|
| ***B65D 17/40*** | (2006.01) |
| ***B65D 79/00*** | (2006.01) |
| ***B65D 17/28*** | (2006.01) |

(52) U.S. Cl.

CPC ..... *B65D 79/005* (2013.01); *B65D 17/4011* (2018.01); *B65D 2517/007* (2013.01); *B65D 2517/0016* (2013.01); *B65D 2517/0092* (2013.01)

(58) Field of Classification Search

CPC ..... B65D 79/005; B65D 17/4011; B65D 2517/0092; B65D 2517/007; B65D 2517/0016

USPC ..... 220/270, 271

See application file for complete search history.

(56) References Cited

U.S. PATENT DOCUMENTS

| | | | |
|---|---|---|---|
| 3,043,461 | A | 7/1962 | Glassco |
| 3,105,765 | A | 10/1963 | Creegan |
| 3,409,167 | A | 11/1968 | Blanchard |
| 3,441,169 | A | 4/1969 | Dunn et al. |
| 3,485,410 | A | 12/1969 | Boik |
| 3,744,666 | A | 7/1973 | Heffner |
| 4,015,744 | A | 4/1977 | Brown |
| 4,030,631 | A | 6/1977 | Brown |
| 4,043,479 | A | 8/1977 | Khoury |
| 4,402,419 | A | 9/1983 | MacPherson |

(Continued)

FOREIGN PATENT DOCUMENTS

| | | |
|---|---|---|
| WO | WO 94-13544 | 6/1994 |
| WO | WO 2015-183812 | 12/2015 |

OTHER PUBLICATIONS

International Searching Authority, International Search Report regarding PCT/US2015/032433, dated Aug. 25, 2015, 16 pages.

(Continued)

*Primary Examiner* — James N Smalley

(74) *Attorney, Agent, or Firm* — Reinhart Boerner Van Deuren s.c.

(57) ABSTRACT

A vented metal can end is provided. The can end includes a tab and a tab rivet. The can end includes an outer score and a vent score. The vent score is formed in the end wall and located beneath the nose of the tab. The vent score is positioned such that the tab rivet is located between the vent score and the center point of the end wall and the vent score is also located between the outer score and the tab rivet.

19 Claims, 9 Drawing Sheets

(56) References Cited

U.S. PATENT DOCUMENTS

| | | | | |
|---|---|---|---|---|
| 5,038,956 | A * | 8/1991 | Saunders | B21D 51/383 220/271 |
| 5,232,114 | A | 8/1993 | Zysset | |
| 5,593,063 | A | 1/1997 | Claydon et al. | |
| 6,050,440 | A | 4/2000 | McEldowney | |
| 8,177,092 | B2 | 5/2012 | Mills | |
| 8,684,211 | B1 | 4/2014 | Stammen | |
| 2005/0284869 | A1 | 12/2005 | Mills | |
| 2007/0215621 | A1 * | 9/2007 | Shinguryo | B65D 17/404 220/269 |
| 2011/0186575 | A1 * | 8/2011 | Dunwoody | B65D 17/163 220/270 |
| 2011/0303672 | A1 | 12/2011 | Fields et al. | |
| 2013/0026169 | A1 | 1/2013 | Burleson, Jr. et al. | |

OTHER PUBLICATIONS

Extended European Search Report for European Application No. 15799854.3, dated Dec. 18, 2017, 8 pages.

* cited by examiner

CAN END FOR PRESSURIZED METAL FOOD CAN WITH SHIELDED VENT SCORE

CROSS-REFERENCE TO RELATED PATENT APPLICATION

This application claims priority to and the benefit of PCT Application No. PCT/US2015/032433 filed on May 26, 2015, which claims priority to U.S. Provisional Patent Application No. 62/005,663 filed May 30, 2014, which are incorporated herein by reference in their entirety.

BACKGROUND OF THE INVENTION

The present invention relates generally to the field of metal food cans. The present invention relates specifically to a can end with a shielded vent score for use with a pressurized metal food can. Can ends are used on can bodies with different dimensions that store a variety of materials, such as perishable food items. Can ends act to hermetically seal contents within the can and also provide an access point to the container contents. In many typical metal food cans, the contents cavity of the sealed and cooled can is held at a pressure less than atmospheric pressure in the case of a hot fill process. In a food with a negative internal pressure, there is not a significant concern over the release or expulsion of material from the can when the can is opened.

SUMMARY OF THE INVENTION

One embodiment of the invention relates to a metal food can end configured to be coupled to a pressurized metal can body via a seam. The can end includes a curl section defining an outer perimeter of the can end. The curl section terminates in a free edge, and the curl section is configured to be crimped with an end of the metal can body to form the seam. The can end includes an end wall located within and surrounded by the curl section. The end wall includes a center panel. The end wall includes a bead panel located outside of and surrounding the center panel, and the bead panel includes at least one bead formed in the bead panel. The end wall includes a score track located outside of and surrounding the bead panel. The can end includes a tab having a nose portion and a finger portion. The can end includes a tab rivet coupling the tab to the end wall such that the nose portion of the tab is located between the curl section, and the tab rivet and the finger portion is positioned on the opposite side of the tab rivet from the nose portion and extending toward a center point of the end wall. The can end includes an outer score formed in the score track. The outer score surrounds the bead panel, and the outer score is configured to be broken by the nose portion of the tab to facilitate removal of a portion of the end wall located within the outer score. The can end includes a vent score formed in the end wall and located beneath the nose of the tab. The vent score is positioned such that the tab rivet is located between the vent score and the center point of the end wall, and the vent score is concentric with an outer surface of the tab rivet.

Another embodiment of the invention relates to a vented metal can end. The vented metal can end includes a curl section terminating in a free edge and defining an outer perimeter of the can end. The vented metal can end includes an end wall located within and surrounded by the curl section. The vented metal can end includes a tab having a nose portion and a finger portion. The vented metal can end includes a tab rivet coupling the tab to the end wall such that the nose portion of the tab is located between the curl section and the tab rivet, and the finger portion is positioned on the opposite side of the tab rivet from the nose portion and extending toward a center point of the end wall. The tab rivet is formed from the material of the end wall and includes a flange extending radially outward from an upper end of the tab rivet. The vented metal can end includes an outer score formed in the end wall, and the outer score is configured to be broken by the nose of the tab to facilitate removal of a portion of the end wall within the outer score. The vented metal can end includes an inner score formed in the end wall. The inner score is located between the outer score and the tab rivet is located between the inner score and the center point of the end wall. At least a portion of the flange of the tab rivet extends radially beyond an inner edge of the inner score.

Another embodiment of the invention relates to a vented metal can end. The vented metal can end includes a curl section terminating in a free edge and defining an outer perimeter of the can end. The vented metal can end includes an end wall located within and surrounded by the curl section. The vented metal can end includes a tab having a nose portion and a finger portion. The vented metal can end includes a tab rivet coupling the tab to the end wall such that the nose portion of the tab is located between the curl section and the tab rivet, and the finger portion is positioned on the opposite side of the tab rivet from the nose portion and extending toward a center point of the end wall. The vented metal can end includes an outer thinned area formed in the end wall having a first thickness. The outer thinned area is configured to be broken by the nose portion of the tab to facilitate removal of a portion of the end wall within the outer score. The vented metal can end includes an inner thinned area formed in the end wall having a second thickness. The inner thinned area is located between the outer thinned area and the tab rivet and the tab rivet is located between the inner thinned area and the center point of the end wall, and the second thickness is less than the first thickness.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
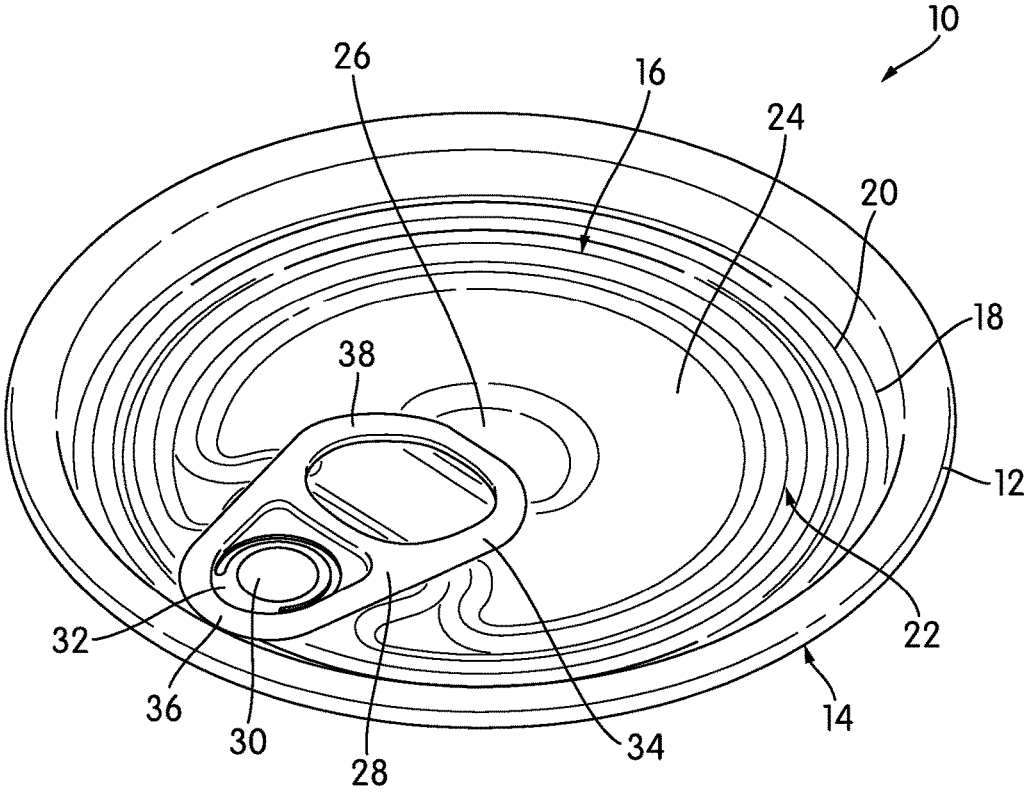
FIG. 1 is a perspective view of a can end according to an exemplary embodiment.

Referring generally to the figures, various embodiments of a metal vented can end and pressurized metal food can including a vented can end are shown. In general, the vented can end disclosed herein includes an outer score and a tab configured to allow opening of the can without the need to use a can opener (e.g., an easy open end). The contents cavity of the can disclosed herein is pressurized (i.e., the internal pressure within the can is greater than atmospheric pressure or greater than the air pressure exterior to the can). However, when such a pressurized can is opened via use of the tab, a small amount of material from within the can tends to be expelled along with the air escaping the can, and if this expulsion occurs through the outer score as the outer score is breached by the tab, the person opening the can may be sprayed by the escaping material. To reduce or prevent the mess that may otherwise be associated with opening a pressurized can, the vented metal can end disclosed herein includes a vent score positioned and structured to both be the first breach through the can end upon opening and to limit or block the expulsion of material through the vent.

In particular, as discussed in more detail below, the vent score is a thinned or weakened portion of the material of the end wall of the can end that is located below the front portion of the tab. As the user begins to open the can via lifting of the tab, the vent score breaks open before the outer score, allowing the pressure within the can to equalize to atmospheric pressure prior to fully opening the can end. Because the vent score is located under the front portion of the tab, the lower surface of the front portion of the tab blocks and contains any material that is expelled through the vent during pressure equalization.

In various embodiments, both the structure and positioning of the vent score provide for improved breakage and/or for improved containment of expelled material. In various embodiments, the vent score is located close to and surrounds the tab rivet. In various embodiments, the vent score is located close to the tab rivet such that the upper flange of the tab rivet extends radially beyond the innermost edge of the vent score. In addition, in various embodiments, the vent score is concentric with and/or extends more than 90 degrees around the outer surface of the vent score. In addition, in various embodiments, the thickness of the material of the end wall at the vent score is less than the thickness of the material of the end wall at the outer score. It is believed that one or more of these structural components of the vent score disclosed herein facilitate breach of the vent score and containment of an expelled material.

In addition, the vented metal can end disclosed herein includes additional structural arrangements to facilitate use of the can end to seal a pressurized can. In various embodiments, the can end includes a sloped or stepped center panel that acts to recess the center of the can end below radially exterior portions of the can end. In various embodiments, this can end structure allows the can end to flex outward under the increased pressure of the contents cavity of the pressurized can to result in can end that appears substantially flat (e.g., not outwardly domed) to the end user.

Referring to FIG. 1, a vented can end, shown as can end 10, is shown according to an exemplary embodiment. Can end 10 includes a curl section 12 that terminates in a free end 14. The radially outer most surface of curl section 12 defines the perimeter of can end 10. In the embodiment shown, can end 10 is substantially circular (e.g., generally circular allowing for standard manufacturing imperfections and tolerances, having a radius that varies less than 1% at all positions around the can end) such that the perimeter of can end 10 is substantially circular in shape. As discussed in more detail below, to attach can end 10 to a can body, the metal material of curl section 12 is interlocked and crimped with a portion of the material of the can body to form a double seam sealing the end of the can body.

Can end 10 includes end wall 16 generally located within and surrounded by curl section 12. In various embodiments, can end 10 includes a counter-sink section 18 located between curl section 12 and end wall 16. End wall 16 includes a score track 20, a bead panel 22, and a center panel 24. Score track 20 is located outside of and surrounding bead panel 22, and bead panel 22 is located outside of and surrounding center panel 24. In the embodiment shown, can end 10 includes a recess or depression, shown as finger well 26, located in the center of can end 10.

Can end 10 includes a tab 28 coupled to end wall 16 by a tab rivet 30. Tab 28 includes a front portion 32 and a rear portion 34. Front portion 32 is located radially outward from tab rivet 30, and rear portion 34 is located radially inward from tab rivet 30. Front portion 32 of tab 28 includes a nose portion 36, and rear portion 34 of tab 28 includes a grip, shown as finger loop 38. In this arrangement, nose portion 36 of tab 28 is located between curl section 12 and tab rivet 30, and finger loop 38 is located on the opposite side of tab rivet 30 and extending toward the center point of end wall 16.

Figure 4:
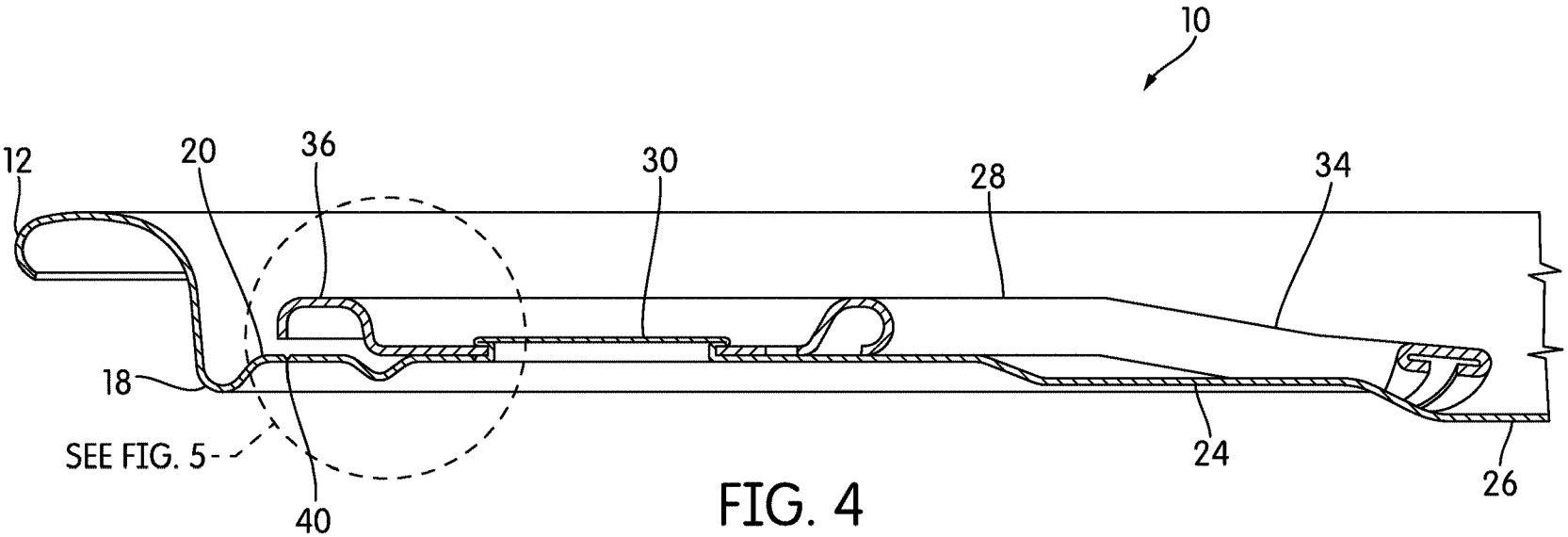
FIG. 4 is a detailed view of a portion of the can end shown in FIG. 3 according to an exemplary embodiment.

Referring to FIG. 4, can end 10 includes an outer score 40 formed in score track 20. In general, outer score 40 is a thinned area of material formed in score track 20. In the embodiment shown, outer score 40 follows a substantially circular path around score track 20 and is substantially concentric with the perimeter of can end 10.

Tab 28 is positioned and configured to facilitate opening of can end 10. As shown in FIG. 4, nose 36 is positioned over outer score 40. The user grasps finger loop 38 and lifts tab 28 up and pivots tab 28 counterclockwise in the orientation of FIG. 4. In this arrangement, nose 36 pivots downward engaging and piercing outer score 40, and then the user grasping tab 28 at finger loop 38 pulls away from the can end. Under this force, outer score 40 breaks around its entire length, and end wall 16 is allowed to separate from the outer portions of can end 10 providing access to the contents of the can.

Figure 3:
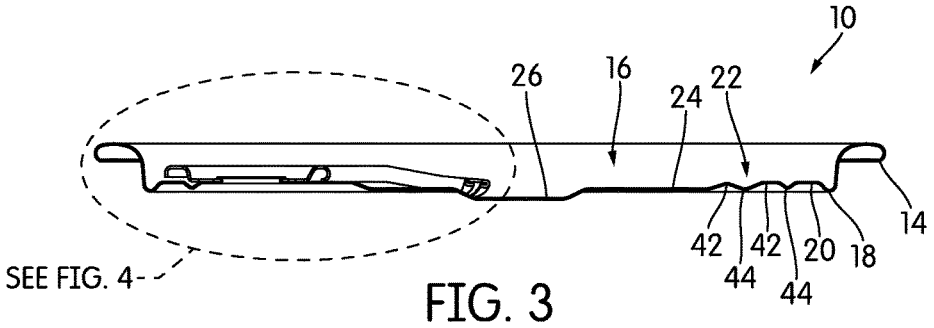
FIG. 3 is a cross-sectional view of the can end of FIG. 1 according to an exemplary embodiment.

As shown best in FIG. 3, can end 10 includes a plurality beads located within bead panel 22. In general, bead panel 22 includes a plurality of upwardly extending beads 42 and plurality of downwardly extending beads 44 located between each upward extending bead 42. This arrangement of alternating upwardly extending and downwardly extending beads allows can end 10 to flex outwardly as pressure increases within the can during thermal processing, such as retort processing or induction heating-based sterilization.

Can end 10 is configured for use with a container, such as a metal food container, in which the contents of the container are pressurized (i.e., are maintained above atmospheric pressure). In various embodiments, the pressurization of can contents may act to support the can body allowing the material of the can body to be thinner than a typical metal food can which has a negative internal pressure.

Figure 2:
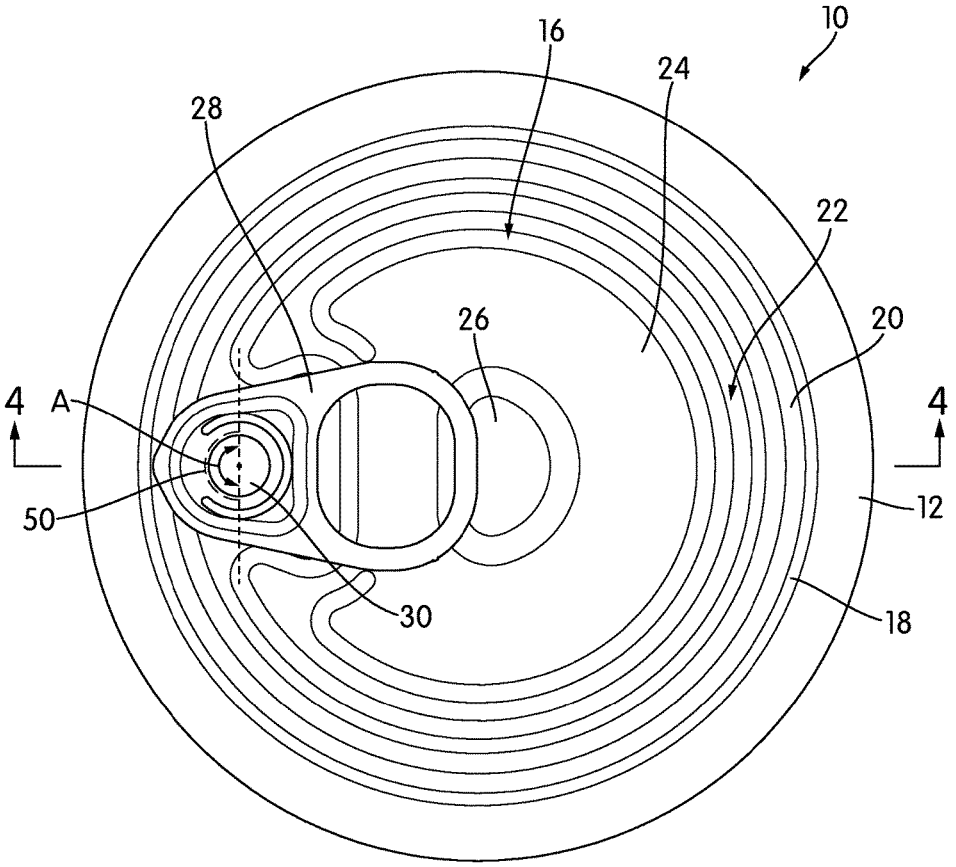
FIG. 2 is a top plan view of the can end of FIG. 1 according to an exemplary embodiment.
Figure 5:
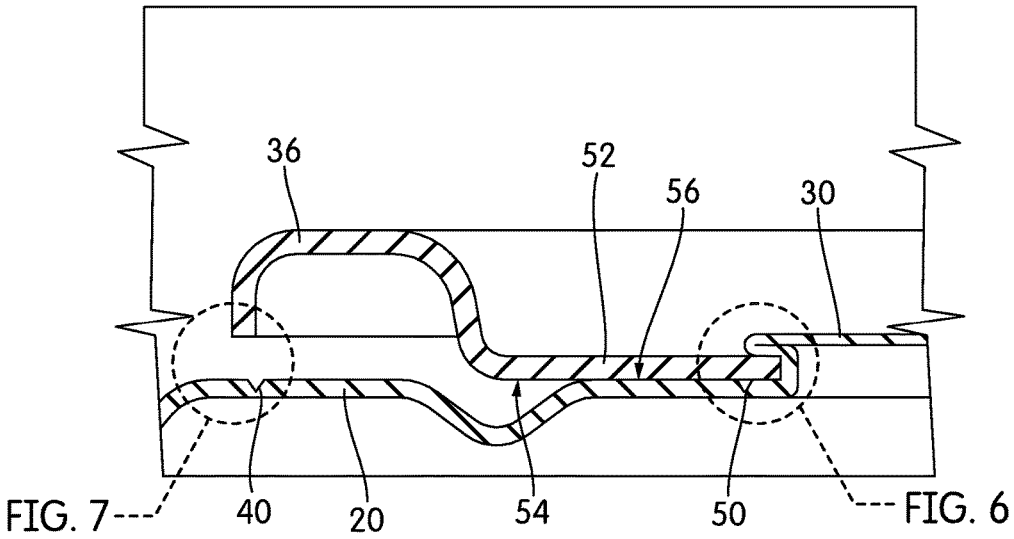
FIG. 5 is a detailed view of a portion of the can end shown in FIG. 4 according to an exemplary embodiment.
Figure 8:
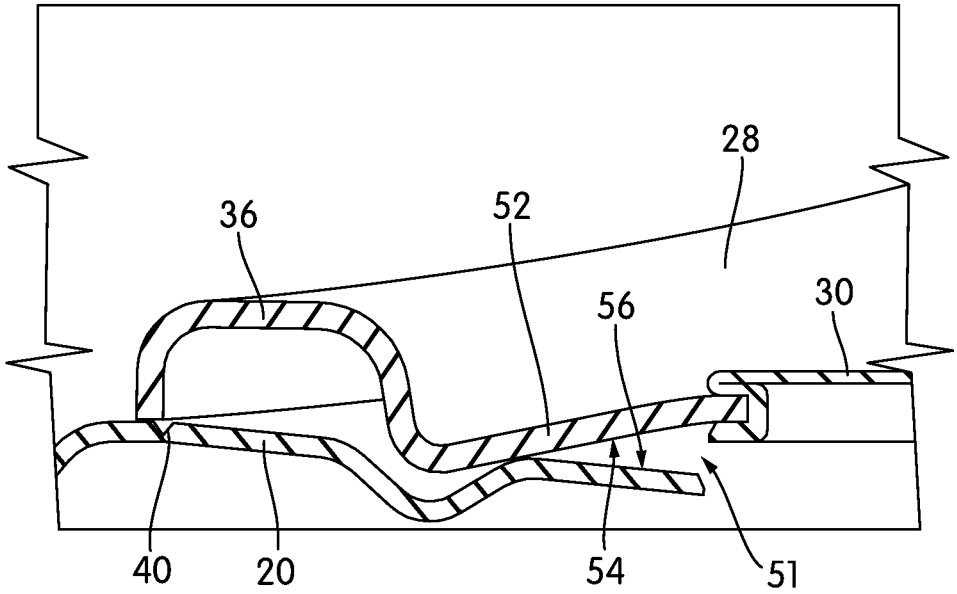
FIG. 8 is a detailed view of the portion of the can end shown in FIG. 5 showing the vent score following opening according to an exemplary embodiment.

Referring specifically to FIG. 2 and FIG. 5, can end 10 includes an inner score, shown as vent score 50 (shown in dashed lines beneath tab 28 in FIG. 2). In general, vent score 50 is a thinned area of the material of end wall 16 that is configured to break before outer score 40 breaks upon operation of tab 28. As shown in FIG. 8, as the user begins to rotate tab 28 counterclockwise (in the orientation of FIG. 8) to open can end 10, tab 28 first pulls upward on tab rivet 30 causing vent score 50 to rupture prior to breakage of outer score 40 by nose 36. Upon opening of vent score 50 a vent opening 51 is formed, and the pressure of the contents cavity of the can to which can end 10 is attached is permitted to equalize with the outside atmospheric pressure prior to rupture of outer score 40.

Referring to FIG. 5 and FIG. 8, vent score 50 is located below a solid wall 52 of the front portion of tab 28. Solid wall 52 acts to block or shield vent score 50 upon opening. In various embodiments, because the contents cavity of the can associated with can end 10 is pressurized, air escaping through a breach in end wall 16 during opening will tend to carry liquid or small solid components of the can contents with it. Because of the positioning of vent score 50 below wall 52, wall 52 acts to block or trap any such expelled contents on the outer surface of end wall 16, and thereby acts to limit or prevent the expelled material from contacting the person opening the can.

In various embodiments, the shape and relative positioning of solid wall 52 of tab 28 and vent score 50 provide for the capture of expelled can contents as discussed above. In various embodiments, the lower surface 54 of solid wall 52 is close to or is in contact with upper surface 56 of the portion of end wall 16 adjacent vent score 50 is formed. In various embodiments, the clearance between lower surface 54 and upper surface 56 is less than 0.1 inches.

In various embodiments, vent score 50 is shaped and positioned to facilitate opening of vent score 50 upon the beginning of the opening action and prior to breakage of outer score 40. As shown in FIG. 8, as the user begins to rotate tab 28 to open can end 10, tab 28 first begins to push upward on tab rivet 30 which applies the force to vent score 50 causing the vent score to open. In various embodiments, vent score 50 is positioned and structured relative to tab rivet 30 to facilitate the breakage of vent score 50 prior to breakage of outer score 40.

As shown in the exemplary embodiment of FIG. 2, vent score 50 is shaped as an arc partially surrounding tab rivet 30. In various embodiments, the arc of vent score 50 is defined by angle A between lines perpendicular to vent score 50 at the leftmost and rightmost edges of vent score 50. In various embodiments, angle A is greater than 90 degrees. In another embodiment, angle A is between 90 degrees and 270 degrees and more specifically is between 135 degrees and 225 degrees. In other embodiments, angle A is less than 90 degrees. In specific embodiments, angle A is between 40 degrees and 120 degrees, specifically is between 60 degrees and 90 degrees and more specifically is about 80 degrees (e.g., 80 degrees plus or minus 1 degree). In various embodiments, angle A is greater than 40 degrees and less than 270 degrees. In various embodiments, tab rivet 30 includes an outer surface 58 that is generally cylindrical, and the arc defined by vent score 50 is substantially concentric with outer surface 58.

Figure 6:
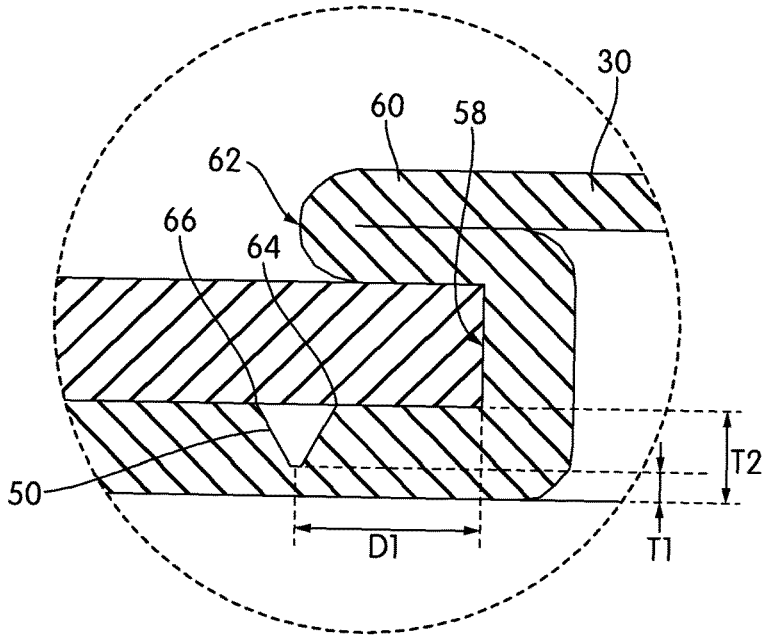
FIG. 6 is a detailed view of a portion of the can end shown in FIG. 5 showing a vent score according to an exemplary embodiment.

Referring to FIG. 6, vent score 50 is spaced a relatively short distance from outer surface 58 of tab rivet 30 to facilitate breakage of vent score 50. As shown in FIG. 6, the radial mid-point of vent score 50 is a distance D1 in the radial direction from outer surface 58 of tab rivet 30. In various embodiments, D1 is between 0.5 and 0.01 inches.

Further, as shown in FIG. 6, tab 28 includes a tab flange 60 extending radially outward from the upper end of tab rivet 30, and tab flange 60 may be positioned relative to vent score 50 to facilitate breakage of vent score 50 as discussed above. In various embodiments, vent score 50 is in substantial vertical alignment with the radially outermost edge 62 of flange 60. In such embodiments, outermost edge 62 extends radially beyond inner edge 64 of vent score 50. In one such embodiment, outermost edge 62 does not extend radially beyond outer edge 66 of vent score 50 such that outermost edge 62 of flange 60 is located between outer edge 66 and inner edge 64 of vent score 50 in the radial direction.

As shown in FIG. 6, vent score 50 is a thinned area of material that is thinner than at least some other areas of the material of can end 10 such that vent score 50 tends to open upon lifting of tab 28 to cause rotation about tab rivet 30. As shown in FIG. 6, vent score 30 has a thickness shown as T1 and the material of can end 10 has a thickness shown as T2. In general, T1 is the vertical distance between the lowest point within vent score 50 within a particular cross-sectional plane and the lower surface of can end 10 as shown in FIG. 6. In various embodiments, T2 is substantially constant across can end 10, and in one embodiment, T2 is the same as the thickness of can end 10 within finger well 26 at the center of end wall 16. In various embodiments, T1 is less than 80% of T2, specifically is less than 50% of T2 and more specifically is less than 30% of T2.

Figure 7:
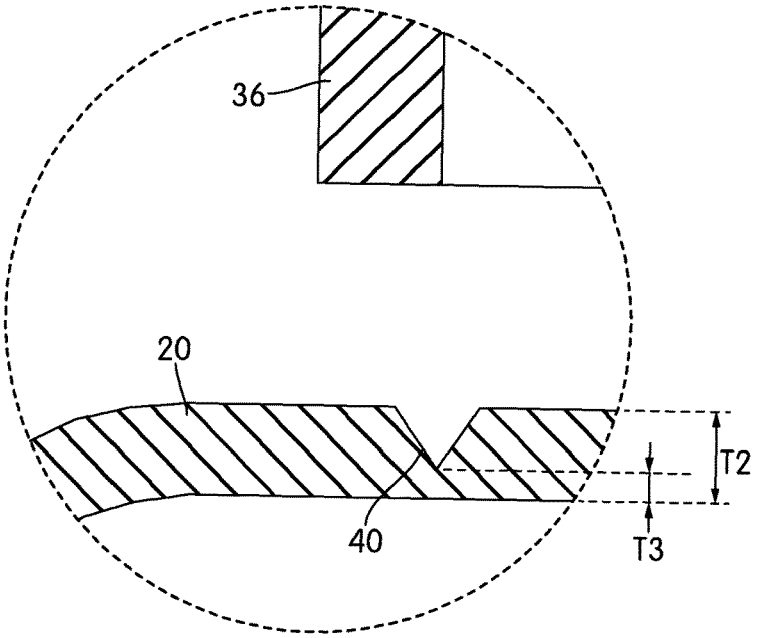
FIG. 7 is a detailed view of a portion of the can end shown in FIG. 5 showing an outer score according to an exemplary embodiment.

In various embodiments, the thickness of the material of can end 10 at vent score 50 shown as T1 is sized relative to the thickness of the material of can end 10 at outer score 40 such that vent score 50 opens before outer score 40. As shown in FIG. 7, outer score 40 has a thickness shown as T3. In general, T3 is the vertical distance between the lowest point within outer score 40 within a particular cross-sectional plane and the lower surface of can end 10 as shown in FIG. 7. In various embodiments, T1 of vent score 50 is less than T3 of outer score 40. In a specific embodiment, T1 of vent score 50 is less than 80% of T3 of outer score 40.

In addition, can end 10 includes a center panel, such as center panel 24, configured for use on a pressurized metal food can. In various embodiments, can end 10 includes a center panel configured and shaped such that can end 10 does not appear to be outwardly domed under the pressure within the pressurized can. Thus, in various embodiments, can end 10 includes a center panel 24 that is generally displaced downward such that can end 10 appears flat when coupled to a can body (as shown for example in FIG. 11) as the internal pressure within the pressurized can pushes the can end outward.

Figure 9:
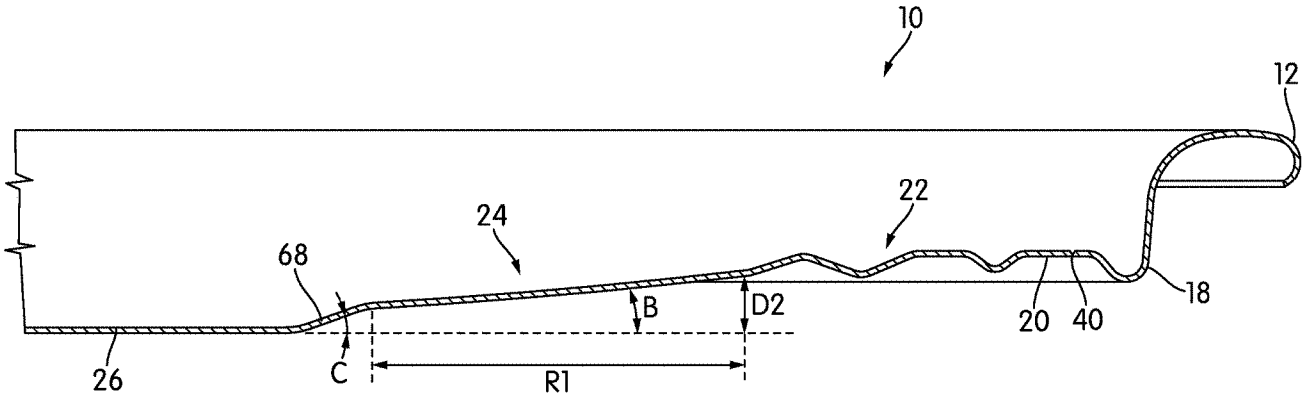
FIG. 9 is a detailed cross-sectional view of a portion of the can end of FIG. 1 according to an exemplary embodiment.

Referring to FIG. 9, a detailed view of center panel 24 is shown according to an exemplary embodiment. As shown in FIG. 9, finger panel 26 is recessed below the upper end of center panel a distance of D2. In various embodiments, D2 is between 0.5 and 0.01 inches.

In the embodiment of FIG. 9, center panel 24 is angled such that center panel 24 slopes radially inward and downward toward finger panel 26. In this embodiment, center panel 24 is a frustoconical section having both an inner surface and an outer surface that forms an angle B relative to a substantially horizontal plane defined by finger panel 26. In various embodiments, angle B is between 1 and 20 degrees, specifically is between 1 and 10 degrees, and more specifically is between 2 and 6 degrees. In a specific embodiment, angle B is between 3.5 and 4.5 degrees, and more specifically is 4 degrees.

In addition, can end 10 includes an inner angled transition section 68 located between the radially innermost end of center panel 24 and the radially outermost end of finger well 26. Transition section 68 is a frustoconical section having both an inner surface and an outer surface that forms an angle C relative to a substantially horizontal plane defined by finger panel 26. In various embodiments, angle C is greater than angle B, and in a specific embodiment angle C is at least four times greater than angle B. In various embodiments, angle C is between 10 and 40 degrees, specifically is between 15 and 35 degrees, and more specifically is between 20 and 30 degrees. In a specific embodiment, angle C is 25 degrees.

Figure 11:
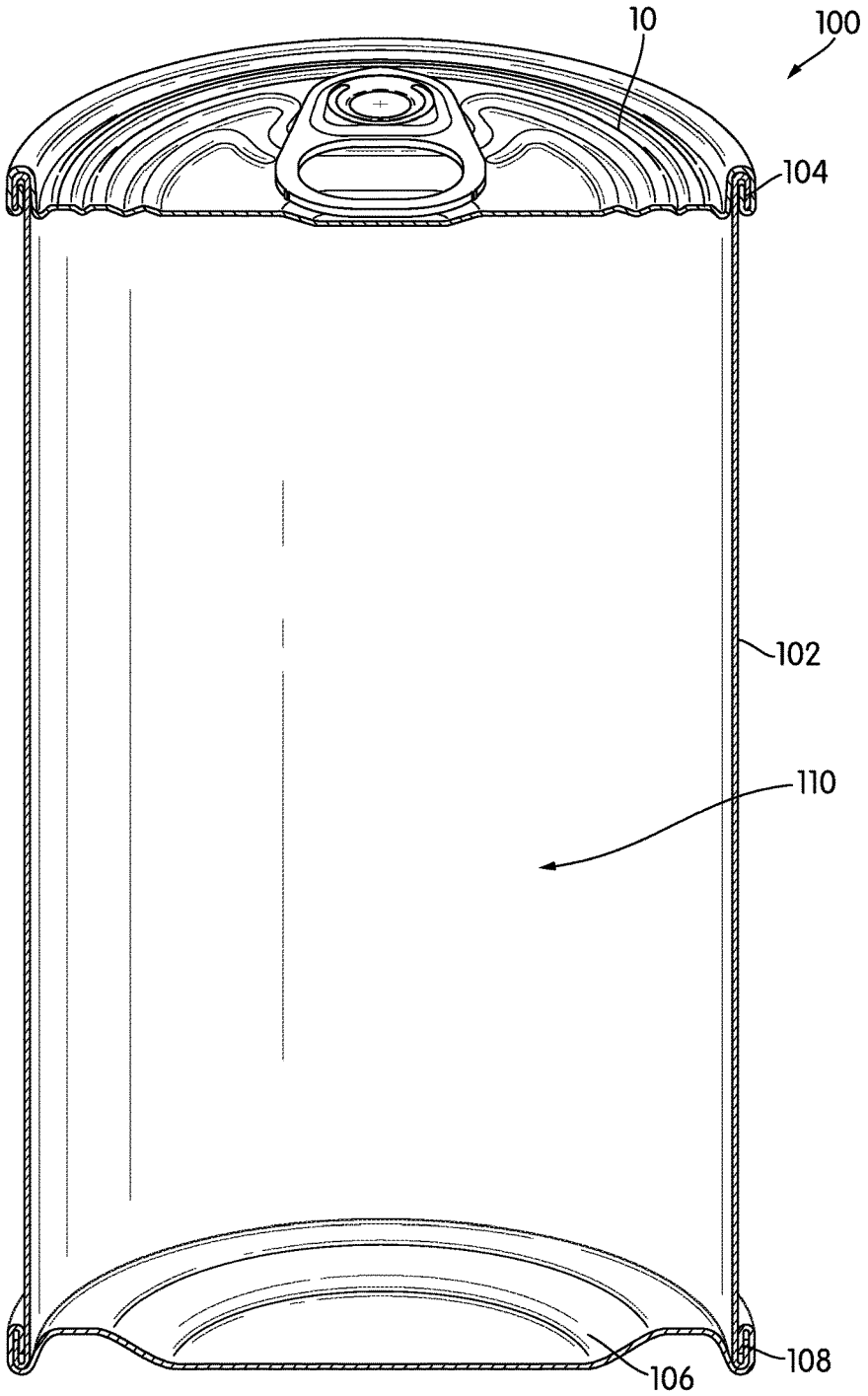
FIG. 11 is a cross-sectional perspective view of the can end of FIG. 1 sealing a can according to an exemplary embodiment.

In addition, center panel 24 has a radial length shown as R1. In various embodiments, R1 is greater than 20% of the outer radius of can end 10, and more specifically is between 20% and 60% of the outer radius of can end 10. In various embodiments, R1 is between 0.25 inches and 0.75 inches. In various embodiments, the relative sizing and positioning of center panel 24 allows end wall 16 to flex outwardly under the internal pressure within the can to form a substantially flat can end as shown in FIG. 11.

Figure 10:
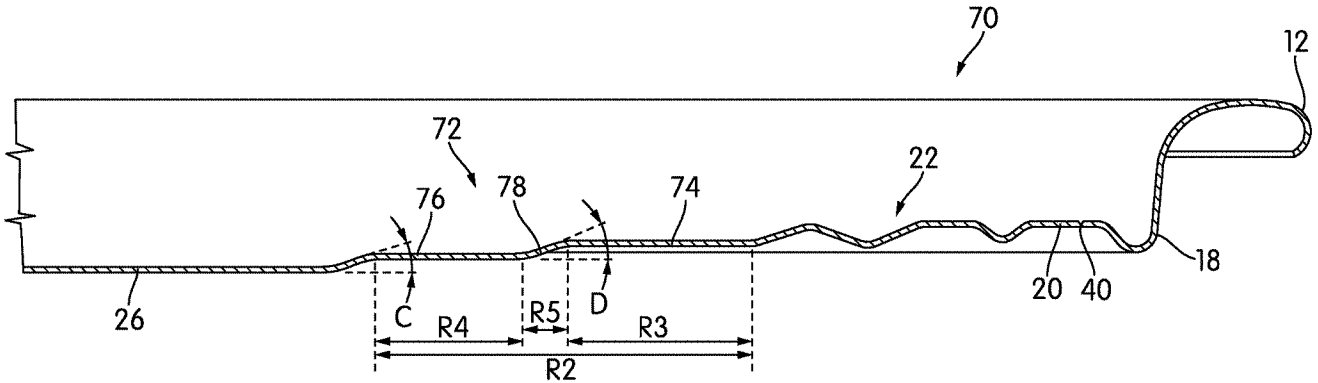
FIG. 10 is a detailed cross-section view of a portion of a can end according to another exemplary embodiment.

Referring to FIG. 10, a vented can end, shown as can end 70, is shown according to another exemplary embodiment. Can end 70 is substantially the same as can end 10, except for the structure of the center panel discussed herein. Can end 70 includes a center panel 72 located between finger well 26 and bead panel 22. In this embodiment, center panel 72 is stepped panel including an upper planar section 74, a lower planar portion 76 and an angled transition section 78. In this embodiment, angled transition section 78 accounts for the height drop within center panel 72.

As shown in FIG. 10, center panel 72 has a radial length R2. In various embodiments, R2 is greater than 20% of the outer radius of can end 10, and more specifically is between 20% and 60% of the outer radius of can end 10. In various embodiments, R2 is between 0.25 inches and 0.75 inches. In addition, upper planar section 74 has a radial length R3, lower planar portion 76 has a radial length R4, and angled transition section 78 has a radial length R5. In various embodiments, as shown in FIG. 10, R3 is greater than R4. In various embodiments, R3 is between 0.05 inches and 0.2 inches. In various embodiments, R4 is between 0.05 inches and 0.2 inches. In various embodiments, R5 is between 0.01 inches and 0.2 inches.

Angled transition section 78 is located between upper planar section 74 and lower planar section 76. Transition section 78 is frustoconical section having an inner surface and an outer surface that forms an angle D relative to a substantially horizontal plane defined by finger panel 26. In various embodiments, angle D is substantially the same as angle C. In various embodiments, angle D is between 10 and 40 degrees, specifically is between 15 and 35 degrees, and more specifically is between 20 and 30 degrees. In a specific embodiment, angle D is 25 degrees.

Referring to FIG. 11, a pressurized metal can, shown as can 100, is shown according to an exemplary embodiment. In general, can 100 includes a metal can body or sidewall 102. A vented can end, such as can end 10, is coupled to one end of sidewall 102, via a seam, shown as double seam 104. Can 100 also includes a second can end, shown as can end 106, coupled to the opposite end of sidewall 102 via a seam, shown as double seam 108. In general, double seams 104 and 108 are hermetic seams of interlocked and crimped sections of the outer portions of can end 10 and of can end 106 and the material of the sidewall 102.

In general, the inner surfaces of sidewall 102, can end 10 and can end 106 define a contents cavity 110 of can 100 configured to hold various products, including a shelf stable food product. In various embodiments, contents cavity 110 is pressurized such that the pressure within can 100 is greater than atmospheric pressure. In some such embodiments, the increased pressure within can 100 acts to support the material of sidewall 102 allowing sidewall 102 to be made from a thinner metal material than may be needed for a nonpressurized can.

Figure 12:
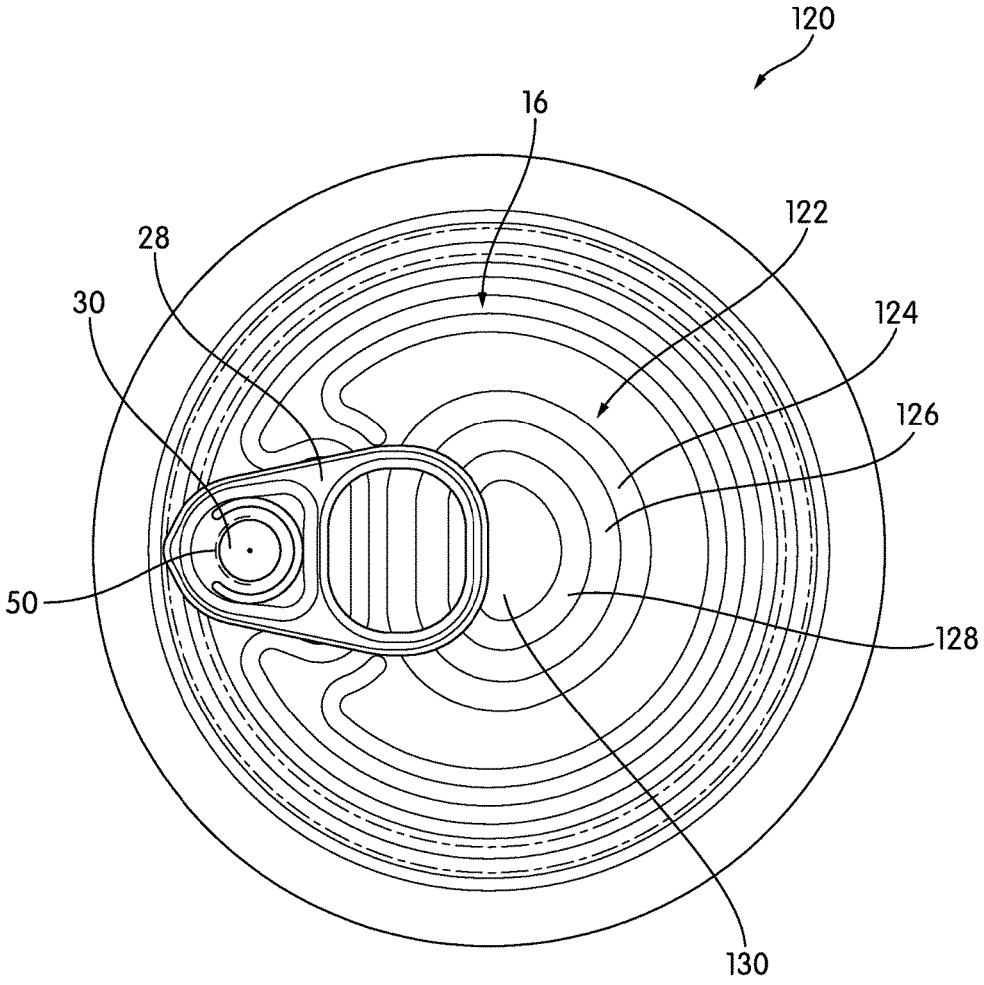
FIG. 12 is a top plan view of a can end according to another exemplary embodiment.

Referring to FIG. 12, another embodiment of a venting can end, shown as can end 120, is shown according to an exemplary embodiment. Can end 120 is substantially the same as can end 10 except as discussed herein. Can end 120 includes a doubled stepped finger panel or well 122 located at the center of end wall 16. Finger well 122 includes an outer angled section 124 that slopes downward to first horizontal surface 126. Finger well 122 includes an inner angled section 128 that slopes downward to central horizontal portion 130. Like finger well 26, finger well 122 provides a depression that allows the user to grasp tab 128.

According to exemplary embodiments, the can end walls and/or can sidewalls discussed herein are formed from metal, and specifically may be formed from stainless steel or tin-coated steel. The can and can ends discussed herein may be of any style, shape, size, etc. For example, the containers and can ends discussed herein may be shaped such that cross-sections taken perpendicular to the longitudinal axis of the container or can end are generally circular. However, in other embodiments the sidewall of the containers discussed herein may be shaped in a variety of ways (e.g., having other non-polygonal cross-sections, as a rectangular prism, a polygonal prism, any number of irregular shapes, etc.) as may be desirable for different applications or aesthetic reasons. In such embodiments, the outer perimeter of the can end may have a shape that substantially matches the cross-sectional shape of the sidewall. In a specific embodiment, can 100 may be hourglass shaped. Can 100 may be of various sizes (e.g., 3 oz., 8 oz., 12 oz., 15 oz., 28 oz., etc.) as desired for a particular application.

As shown in FIG. 11, the upper and lower can ends discussed above are shown coupled to the can body via a "double seam" formed from the interlocked portions of material of the can sidewall and the can end. However, in other embodiments, the can ends discussed herein may be coupled to the sidewall via other mechanisms. For example, can ends may be coupled to the sidewall via welds, such as laser welds, or solders. Can 100 is shown in FIG. 9 as a three-piece can having an upper can end, a lower can end and a sidewall each formed from a separate piece of material. However, in other embodiments, can 100 may be a two-piece can (i.e., a can including a sidewall and an end wall that are integrally formed and a separate can end component joined to the sidewall via a double seam), and a vented can end, such as can end 10, may be attached to the other end.

The containers discussed herein may be used to hold perishable materials (e.g., food, drink, pet food, milk-based products, etc.). It should be understood that the phrase "food" used to describe various embodiments of this disclosure may refer to dry food, moist food, powder, liquid, or any other drinkable or edible material, regardless of nutritional value. In other embodiments, the containers discussed herein may be used to hold non-perishable materials or non-food materials. In various embodiments, the containers discussed herein may contain a product that is packed in liquid that is drained from the product prior to use. For example, the containers discussed herein may contain vegetables, pasta or meats packed in a liquid such as water, brine, or oil.

According to various exemplary embodiments, the inner surfaces of the upper and lower can ends and the sidewall may include a liner (e.g., an insert, coating, lining, a protective coating, sealant, etc.). The protective coating acts to protect the material of the container from degradation that may be caused by the contents of the container. In an exemplary embodiment, the protective coating may be a coating that may be applied via spraying or any other suitable method. Different coatings may be provided for different food applications. For example, the liner or coating may be selected to protect the material of the container from acidic contents, such as carbonated beverages, tomatoes, tomato pastes/sauces, etc. The coating material may be a vinyl, polyester, epoxy, EVOH, a BPA-free polymer and/or other suitable lining material or spray. The interior surfaces of the container ends may also be coated with a protective coating as described above.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A metal food can end configured to be coupled to a pressurized metal can body via a seam, the can end comprising:

- a curl section defining an outer perimeter of the can end, the curl section terminating in a free edge, the curl section configured to be crimped with an end of the metal can body to form the seam;
- an end wall located within and surrounded by the curl section, the end wall comprising:
  - a center panel;
  - a bead panel located outside of and surrounding the center panel, the bead panel including at least one bead formed in the bead panel; and
  - a score track located outside of and surrounding the bead panel;
- a tab having a nose portion and a finger portion;
- a tab rivet coupling the tab to the end wall such that the nose portion of the tab is located between the curl section and the tab rivet and the finger portion is positioned on the opposite side of the tab rivet from the nose portion and extending toward a center point of the end wall;
- an outer score formed in the score track, the outer score surrounding the bead panel, the outer score configured to be broken by the nose portion of the tab to facilitate removal of a portion of the end wall located within the outer score; and
- a vent score formed in the end wall and located beneath the nose of the tab, the vent score positioned such that the tab rivet is located between the vent score and the center point of the end wall and the vent score is located between the tab rivet and the outer score, wherein the vent score is concentric with an outer surface of the tab rivet.

2. The metal food can end of claim 1 wherein the thickness of the end wall at the vent score is less than 80% of the thickness of the end wall at the center panel.

3. The metal food can end of claim 2 wherein the vent score has a leftmost edge and a rightmost edge, and the vent score is a continuous curved score extending between the leftmost edge and the rightmost edge, wherein an angle formed between lines perpendicular to the vent score at the leftmost edge and at the right most edge is greater than 40 degrees.

4. The metal food can end of claim 3 wherein the angle formed between the lines perpendicular to the vent score at the leftmost edge and at the rightmost edge is less than 270 degrees.

5. The metal food can end of claim 1 wherein the end wall further comprises a finger well located within and surrounded by the center panel, wherein the finger well is recessed below the center panel and the bead panel.

6. The metal food can end of claim 1 coupled to a can body via a seam.

7. The metal food can end of claim 6 wherein the can body defines a contents cavity, wherein contents are located in the contents cavity and the can body is hermetically sealed and the contents cavity is at a pressure greater than atmospheric pressure.

8. A metal food can end configured to be coupled to a pressurized metal can body via a seam, the can end comprising:

a curl section defining an outer perimeter of the can end, the curl section terminating in a free edge, the curl section configured to be crimped with an end of the metal can body to form the seam;

an end wall located within and surrounded by the curl section, the end wall comprising:

a center panel;

a bead panel located outside of and surrounding the center panel, the bead panel including at least one bead formed in the bead panel; and a score track located outside of and surrounding the bead panel;

a tab having a nose portion and a finger portion;

a tab rivet coupling the tab to the end wall such that the nose portion of the tab is located between the curl section and the tab rivet and the finger portion is positioned on the opposite side of the tab rivet from the nose portion and extending toward a center point of the end wall, wherein the tab rivet further comprises a flange extending radially outward from an upper end of the tab rivet;

an outer score formed in the score track, the outer score surrounding the bead panel, the outer score configured to be broken by the nose portion of the tab to facilitate removal of a portion of the end wall located within the outer score; and a vent score formed in the end wall and located beneath the nose of the tab, the vent score positioned such that the tab rivet is located between the vent score and the center point of the end wall, wherein the vent score is concentric with an outer surface of the tab rivet, wherein at least a portion of the vent score is located beneath the flange of the tab rivet.

9. The metal food can end of claim 8 wherein an outer edge of the flange of the tab rivet is located vertically above the vent score and is located radially between an outer edge and an inner edge of the vent score.

10. A metal food can end configured to be coupled to a pressurized metal can body via a seam, the can end comprising:

a curl section defining an outer perimeter of the can end, the curl section terminating in a free edge, the curl section configured to be crimped with an end of the metal can body to form the seam;

an end wall located within and surrounded by the curl section, the end wall comprising:

a center panel;

a bead panel located outside of and surrounding the center panel, the bead panel including at least one bead formed in the bead panel;

a finger well located within and surrounded by the center panel, wherein the finger well is recessed below the center panel and the bead panel; and a score track located outside of and surrounding the bead panel;

wherein the center panel includes an inwardly sloped segment extending from the bead panel to a perimeter of the finger well, wherein a radial length of the sloped segment of the center panel is greater than 20% of an outer radius of the can end;

a tab having a nose portion and a finger portion;

a tab rivet coupling the tab to the end wall such that the nose portion of the tab is located between the curl section and the tab rivet and the finger portion is positioned on the opposite side of the tab rivet from the nose portion and extending toward a center point of the end wall;

an outer score formed in the score track, the outer score surrounding the bead panel, the outer score configured to be broken by the nose portion of the tab to facilitate removal of a portion of the end wall located within the outer score; and a vent score formed in the end wall and located beneath the nose of the tab, the vent score positioned such that the tab rivet is located between the vent score and the center point of the end wall, wherein the vent score is concentric with an outer surface of the tab rivet.

11. A metal food can end configured to be coupled to a pressurized metal can body via a seam, the can end comprising:

a curl section defining an outer perimeter of the can end, the curl section terminating in a free edge, the curl section configured to be crimped with an end of the metal can body to form the seam;

an end wall located within and surrounded by the curl section, the end wall comprising:

a center panel;

a bead panel located outside of and surrounding the center panel, the bead panel including at least one bead formed in the bead panel;

a finger well located within and surrounded by the center panel, wherein the finger well is recessed below the center panel and the bead panel; and a score track located outside of and surrounding the bead panel;

wherein the center panel includes an outer planar section, an inner planar section and a transition section between the outer planar section and the inner planar section, wherein the inner planar section is recessed below the outer planar section and is located above the finger well, wherein the transition section is a sloped section providing the transition from the outer planar section to the inner planar section;

a tab having a nose portion and a finger portion;

a tab rivet coupling the tab to the end wall such that the nose portion of the tab is located between the curl section and the tab rivet and the finger portion is positioned on the opposite side of the tab rivet from the nose portion and extending toward a center point of the end wall;

an outer score formed in the score track, the outer score surrounding the bead panel, the outer score configured to be broken by the nose portion of the tab to facilitate removal of a portion of the end wall located within the outer score; and a vent score formed in the end wall and located beneath the nose of the tab, the vent score positioned such that the tab rivet is located between the vent score and the center point of the end wall, wherein the vent score is concentric with an outer surface of the tab rivet.

12. A vented metal can end comprising:

a curl section terminating in a free edge and defining an outer perimeter of the can end;

an end wall located within and surrounded by the curl section;

a tab having a nose portion and a finger portion;

a tab rivet coupling the tab to the end wall such that the nose portion of the tab is located between the curl section and the tab rivet and the finger portion is positioned on the opposite side of the tab rivet from the nose portion and extending toward a center point of the end wall, wherein the tab rivet is formed from the material of the end wall and comprises a flange extending radially outward from an upper end of the tab rivet;

an outer score formed in the end wall, the outer score configured to be broken by the nose of the tab to facilitate removal of a portion of the end wall within the outer score; and an inner score formed in the end wall, wherein the inner score is located between the outer score and the tab rivet and the tab rivet is located between the inner score and the center point of the end wall, wherein at least a portion of the flange of the tab rivet extends radially beyond an inner edge of the inner score.

13. The vented metal can end of claim 12 wherein the outer perimeter of the can end is substantially circular in shape, wherein the outer score is substantially concentric with the outer perimeter, wherein the tab rivet includes an outer surface that is substantially circular in cross-section, wherein the inner score is substantially concentric with the outer surface of the tab rivet.

14. The vented metal can end of claim 12 wherein the inner score has a leftmost edge and a rightmost edge, and the inner score is a continuous curved score extending between the leftmost edge and the rightmost edge, wherein an angle formed between lines perpendicular to the inner score at the leftmost edge and at the rightmost edge is greater than 60 degrees.

15. The vented metal can end of claim 14 wherein the angle formed between lines perpendicular to the inner score at the leftmost edge and at the rightmost edge is less than 90 degrees.

16. The vented metal can end of claim 12 wherein the thickness of the material of the end wall at the inner score is less than the thickness of the material of the end wall at the outer score.

17. The vented metal can end of claim 16 wherein the thickness of the end wall at the inner score is less than 80% of the thickness of the end wall at the center point.

18. A vented metal can end comprising:

a curl section terminating in a free edge and defining an outer perimeter of the can end;

an end wall located within and surrounded by the curl section;

a tab having a nose portion and a finger portion;

a tab rivet coupling the tab to the end wall such that the nose portion of the tab is located between the curl section and the tab rivet and the finger portion is positioned on the opposite side of the tab rivet from the nose portion and extending toward a center point of the end wall, wherein the tab rivet further comprises a flange extending radially outward from an upper end of the tab rivet, and wherein at least a portion of the flange of the tab rivet extends radially beyond an inner edge of the inner thinned area;

an outer thinned area formed in the end wall having a first thickness, the outer thinned area configured to be broken by the nose portion of the tab to facilitate removal of a portion of the end wall within the outer score; and an inner thinned area formed in the end wall having a second thickness, wherein the inner thinned area is located between the outer thinned area and the tab rivet and the tab rivet is located between the inner thinned area and the center point of the end wall, wherein the second thickness is less than the first thickness.

19. The vented metal can end of claim 18 wherein the outer perimeter of the can end is substantially circular in shape, wherein the outer thinned area is substantially concentric with the outer perimeter, wherein the tab rivet includes an outer surface that is substantially circular in cross-section, wherein the inner thinned area is substantially concentric with the outer surface of the tab rivet, wherein the inner thinned area has a leftmost edge and a rightmost edge, and the inner thinned area extends between the leftmost edge and the rightmost edge, wherein an angle formed between lines perpendicular to the inner thinned area at the leftmost edge and at the rightmost edge is between 60 degrees and 90 degrees.

* * * * *